United States Patent [19]

Griffith et al.

[11] 4,386,490

[45] Jun. 7, 1983

[54] APPARATUS FOR COLLATING, CUTTING AND PACKING FOOD PRODUCTS

[75] Inventors: Robert L. Griffith; John G. Carlson; Daniel E. Gritzner, all of Cedar Falls; William H. Mullan, Fort Madison, all of Iowa

[73] Assignee: Armour-Dial, Inc., Phoenix, Ariz.

[21] Appl. No.: 253,647

[22] Filed: Apr. 13, 1981

[51] Int. Cl.[3] ..... B65B 5/06

[52] U.S. Cl. ..... 53/148; 53/236; 53/247; 53/252

[58] Field of Search ..... 53/148, 247, 252, 250, 53/251, 236, 258, 517, 515, 540, 534

[56] References Cited

U.S. PATENT DOCUMENTS

| | | | |
|---|---|---|---|
| 2,769,291 | 11/1956 | Christensen et al. | 53/515 |
| 2,966,768 | 1/1961 | Zilver | 53/148 |
| 3,179,041 | 4/1965 | Luthi et al. | 53/517 X |
| 3,279,147 | 10/1966 | Garapolo | 53/252 |
| 3,357,155 | 12/1967 | Carruthers | 53/517 X |
| 3,505,777 | 4/1970 | Tsutsumi | 53/540 X |
| 3,750,676 | 8/1973 | Kruse et al. | 53/148 X |
| 3,994,321 | 11/1976 | Eisenberg | 53/534 X |
| 4,095,391 | 6/1978 | Anguiano | 53/515 |
| 4,248,027 | 2/1981 | Cleary et al. | 53/251 X |

*Primary Examiner*—Horace M. Culver

*Attorney, Agent, or Firm*—Frank T. Barber; Richard G. Harrer

[57] ABSTRACT

This invention relates to improvements in apparatus for collating, cutting and packing containers with stick-like food products such as cooked sausages of the type commonly known as vienna sausages, hot dogs and the like.

15 Claims, 11 Drawing Figures

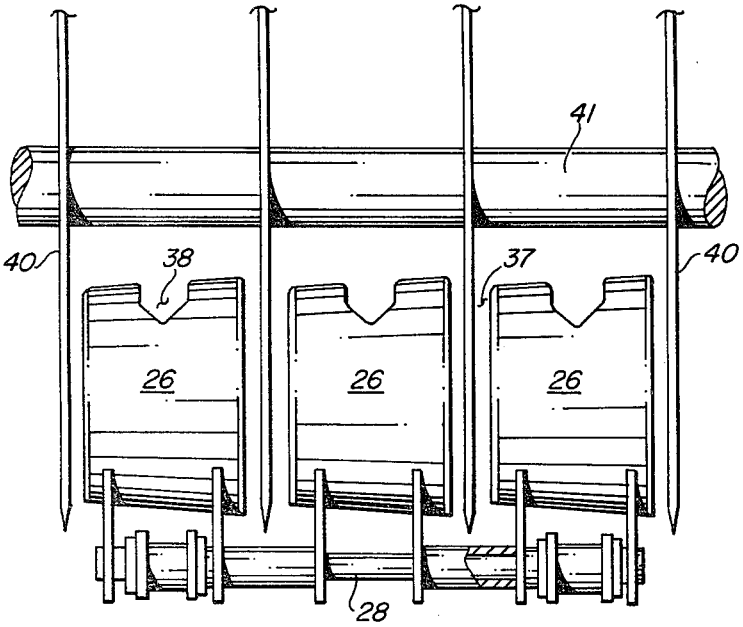
FIG. 7
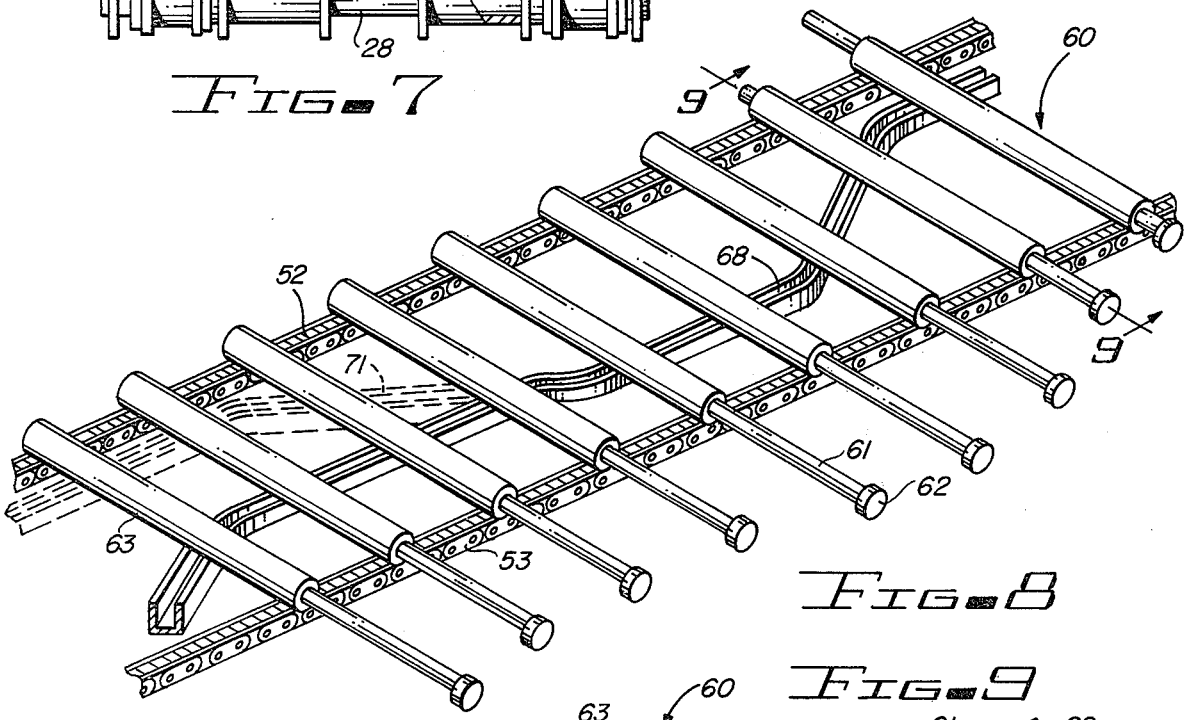
FIG. 8
FIG. 9
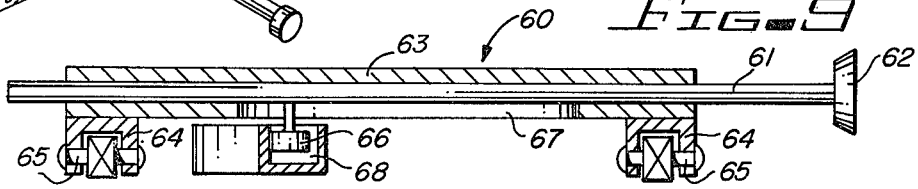
FIG. 10
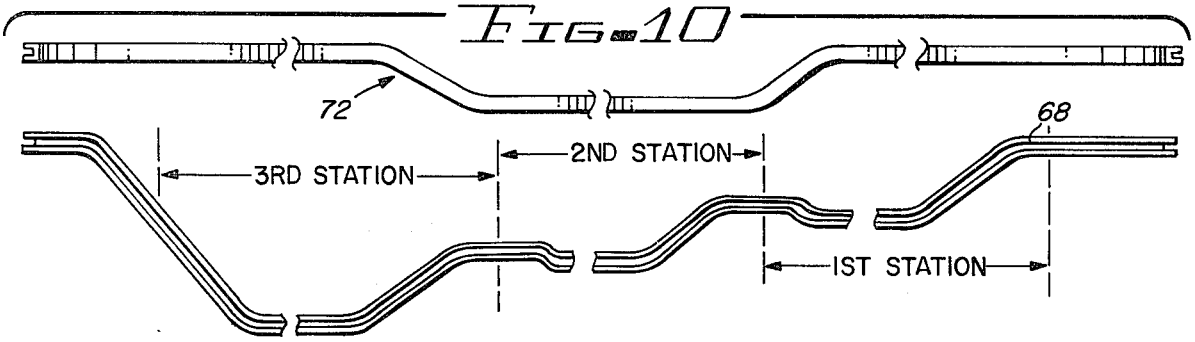

APPARATUS FOR COLLATING, CUTTING AND PACKING FOOD PRODUCTS

BACKGROUND OF THE INVENTION

A cooked sausage product such as vienna sausage is normally packaged in metal or glass containers and the fact that such products are normally packaged in such rigid containers presents problems which are not present in such packages as flexible plastic packaging and plastic trays. In preparing a cooked sausage product such as vienna sausage, a meat emulsion is prepared and stuffed into cellulose casings ranging from 100 to 160 feet in length. The stuffed casing is then passed into a linking machine where the stuffed casing is linked by a twisting operation into suitable lengths and for vienna sausage this is normally about 28–30 inches. Following linking, the stuffed casing goes through a cooking operation to coagulate the emulsion and produce a firm product that can eventually be separated from the casing. The product is normally chilled to facilitate peeling of the casing and further handling. After the peeling operation, the individual sausage lengths are now ready to be cut to appropriate lengths and inserted into metal or glass containers. Equipment is presently available which will cut the vienna sausage to appropriate lengths (i.e. about 2¼ inches) and for placing groups of such cut sausages into containers and is available from Marlen Research Corporation. In its operation the lengths of sausage which have been removed from the casings are placed by operators into a series of metal cups which are open at the top and which are mounted to a conveyor chain. For lengths of sausage of about 28½ inches, approximately 12 of these metal cups are mounted side by side on the conveyor chain and the long lengths of sausage are placed into the cups through an opening in the top. Each operator usually places one or two long lengths of sausage in the cups as the conveyor travels by. Normally about seven such lengths are placed into the cups. The cups are mounted on a conveyor chain in tandem with the axis of the cups on the longitudinal axis of the machine. In addition, each cup is so mounted that it can rotate 90 degrees. The conveyor chain carries the sausages in the cups to a helical knife which cuts the sausages at 90 degrees to the longitudinal axis to the appropriate length—usually about 2¼ inches. After the cutting operation each individual cup is rotated 90 degrees and the individual cups pass to a star wheel that holds a series of empty cans. The cups are brought into registry with the individual empty cans and a cam-operated push rod then transfers the group of seven sausages from the cup to the can and immediately withdraws. Thereafter the filled can is conveyed away for inspection, sealing of the can and usually a final sterilizing operation.

Although equipment as described will continuously produce from 200 to 450 cans of product per minute depending on production requirements and the number of operators, there are several problems attendant with its use. First of all, the aligning and placement of the longer sausage lengths into the cups is done by hand and unless these links of sausage are properly aligned in the cups, it is possible that the end cups may ultimately have sausages which are too short, resulting in short weight in the product in the can. In addition, because these sausages are relatively long, i.e. about 28 to 30 inches, they are susceptible to breakage, especially when one considers that these lengths are hand carried from the peeling machine to the cutting and canning equipment. In addition, individual cups are of a fixed diameter and are somewhat difficult to load. Furthermore, experience with this type of equipment indicates that the hand loading of the cups is tedious work and it is often difficult to maintain efficiency because of fatigue of the operators.

SUMMARY OF THE INVENTION

The present invention is directed to improvements in apparatus for collating, cutting and packing stick-like food products such as vienna sausage, which apparatus requires only a minimum of manual handling of the sausages and to improve quality control of the final packaged product.

Accordingly, a principal object of the present invention is to provide improved apparatus for collating, cutting and packing stick-like food products such as cooked sausages at high speed and requiring virtually no manual handling of the products.

A further object of the invention is to provide, in apparatus of the foregoing type, improved means for automatically transferring cooked sausages into cup-like receptacles prior to cutting such sausages into suitable lengths for packaging.

A still further object of the invention is to provide, in apparatus of the foregoing type, improved means for holding the cooked sausage product in cup-like receptacles during the cutting operation and in the transfer of the cut sausages to suitable containers.

Briefly described, the improved collating, cutting and packaging apparatus of the invention comprises apparatus for sequentially advancing a plurality of the stick-like or elongated food products, such as cooked sausage, in parallel, axially aligned relationship to a station where a pre-determined number of the sausages are swept by rotating fingers into openable cup-like receptacles mounted on an endless conveyor. After the sausages are deposited into the cup-like receptacles, the receptacles automatically close to secure the sausages within the receptacles. The receptacles containing sausages travel to apparatus for cutting the sausages into suitable lengths and thereafter the cut sausages still retained in the cup-like receptacles are automatically transferred by push rod assemblies to containers.

BRIEF DESCRIPTION OF THE DRAWINGS

FIG. 7 is a sectional view of the cutting assembly taken on a line 7—7 of FIG. 1.

FIG. 8 is a perspective view of the pusher assembly with accompanying cam track.

FIG. 9 is a sectional view of the pusher assembly taken on line 9—9 of FIG. 8.

FIG. 10 is a plan view of cam track pathways.

DETAILED DESCRIPTION OF THE INVENTION

Figure 1:
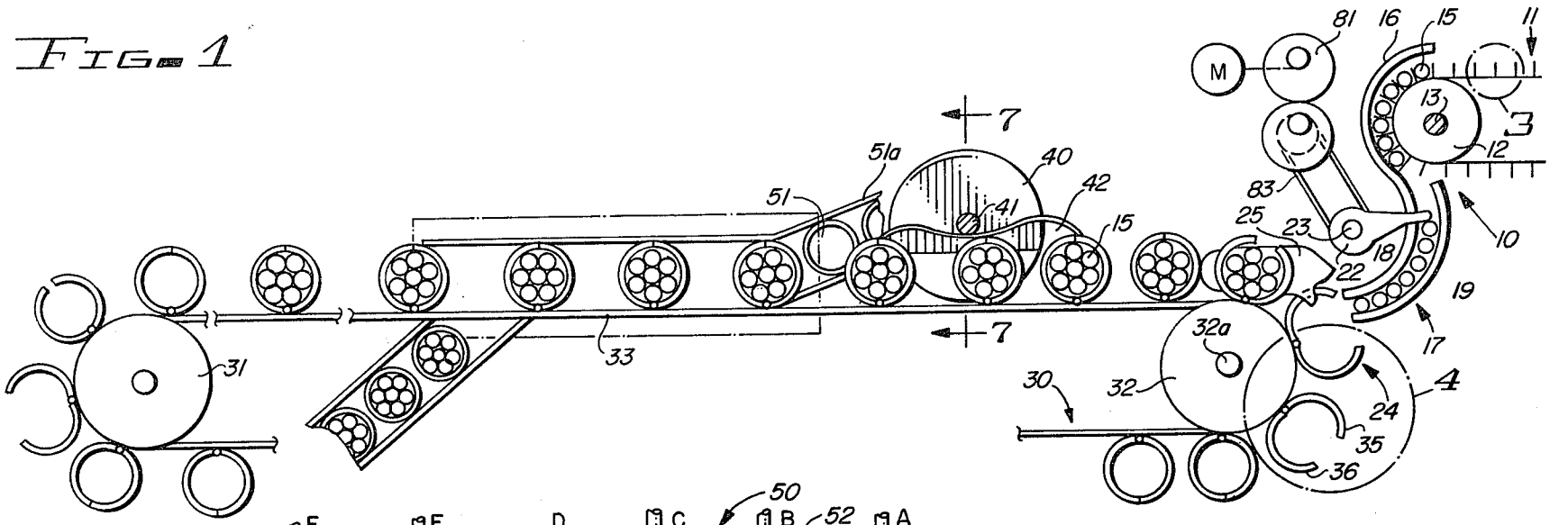
FIG. 1 is a side elevational view of a preferred embodiment of the collating, cutting and packing apparatus of the present invention, with portions of the structure being omitted for clarity.
Figure 3:
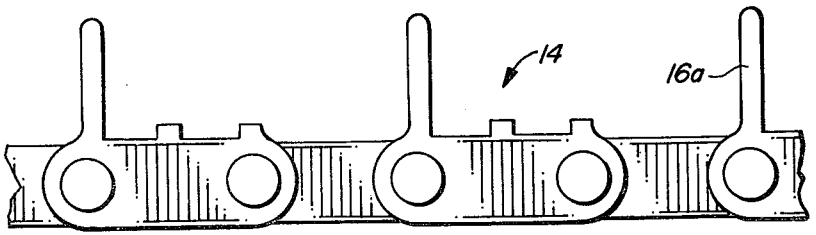
FIG. 3 is an enlarged side view of the bucket chain shown in FIG. 1 at point 3.
Figure 11:
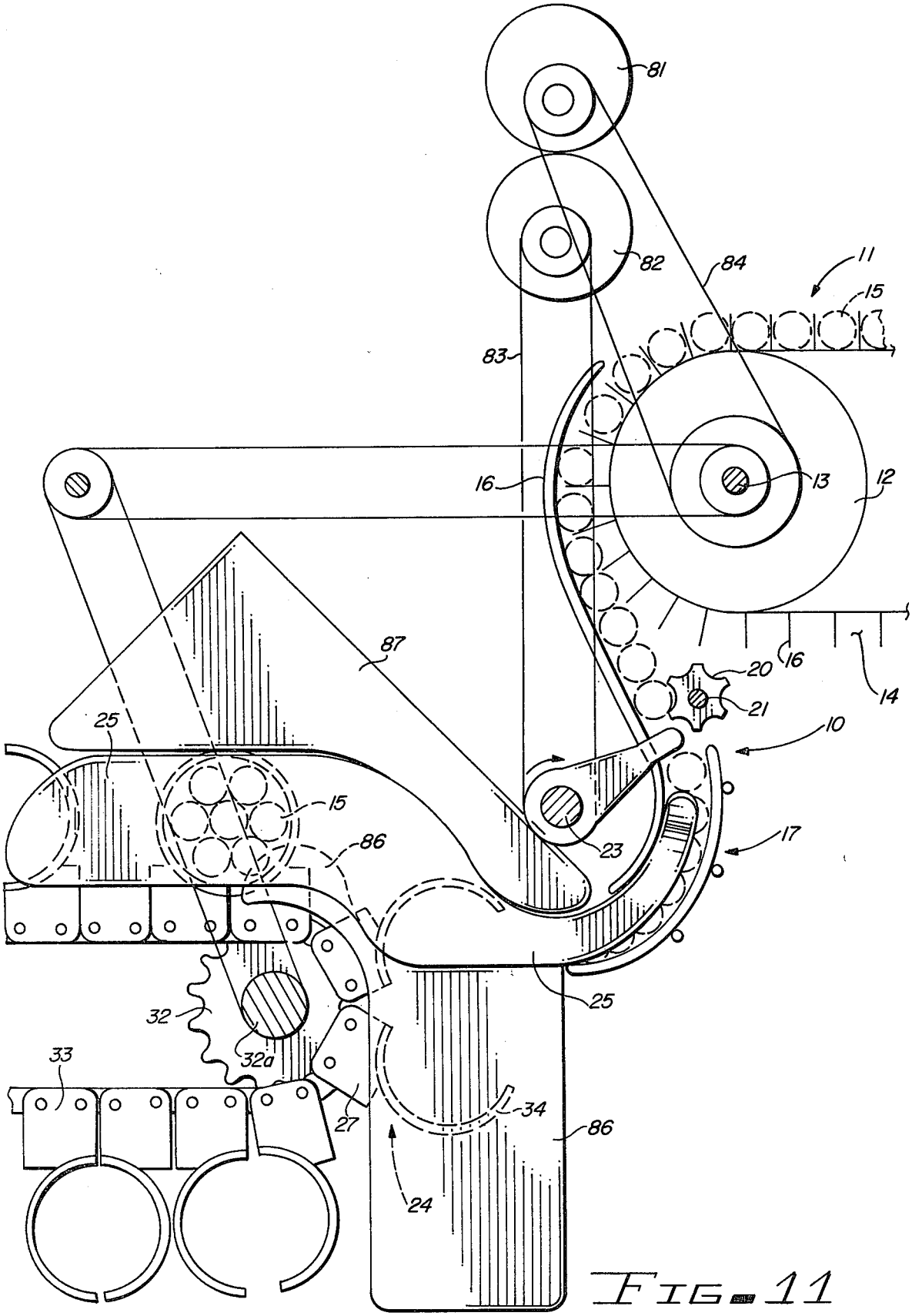
FIG. 11 is a detailed side view of the apparatus for accumulating sausages and for depositing said sausages into openable cup-like receptacles mounted on an endless conveyor.

Referring to FIG. 1, a preferred embodiment of the improved apparatus of the present invention is shown in side-elevational view with portions of the structure being omitted for clarity. The basic elements of this aspect of the apparatus includes means designated generally at 10 for transporting a plurality of elongated articles such as vienna sausages in parallel, axially aligned relationship to a station where a predetermined number of said sausages are swept by a series of rotating fingers into openable cup-like receptacles which are mounted on an endless conveyor. Included in means 10 is an endless conveyor which consists of sprocket 12 mounted to shaft 13 and bucket conveyor 11 which is provided with compartments 14 for holding product 15, and as shown more clearly in FIG. 3, each compartment of the bucket chain is separated by flight 16. As the sprocket 12 rotates, for example, in a counterclockwise direction, the product 15 is conveyed about the sprocket and is retained in the individual compartments by a front cage 16 and eventually drops into a chute-like area, the lower cage assembly 17, defined by the lower portion 18 of front cage 16 and lower cage 19. As shown in FIG. 11, this aspect of the apparatus is also provided with a metering device 20 mounted on shaft 21 which serves to engage and then release product to the lower cage assembly 17 defined by the lower portion 18 of the front cage and the lower cage 19. Mounted adjacent to this chute-like area is a series of rotatable product sweep fingers 22 mounted on shaft 23. Sweep fingers 22 rotate a full 360° and as they rotate the ends of the sweep fingers engage product 15 in the chute area and force the product into an open cup-like assembly 24 mounted on endless conveyor designated generally at 30. It will be noted that when metering device 20 rotates it also functions to provide a space between successive pieces of product so that product sweep fingers 22 can readily impose themselves between predetermined groups of product. As shown in FIG. 11 a pair of side guides 25 are positioned on each side of lower cage assembly 17 and serve to keep the product in alignment in this area.

Figure 2:
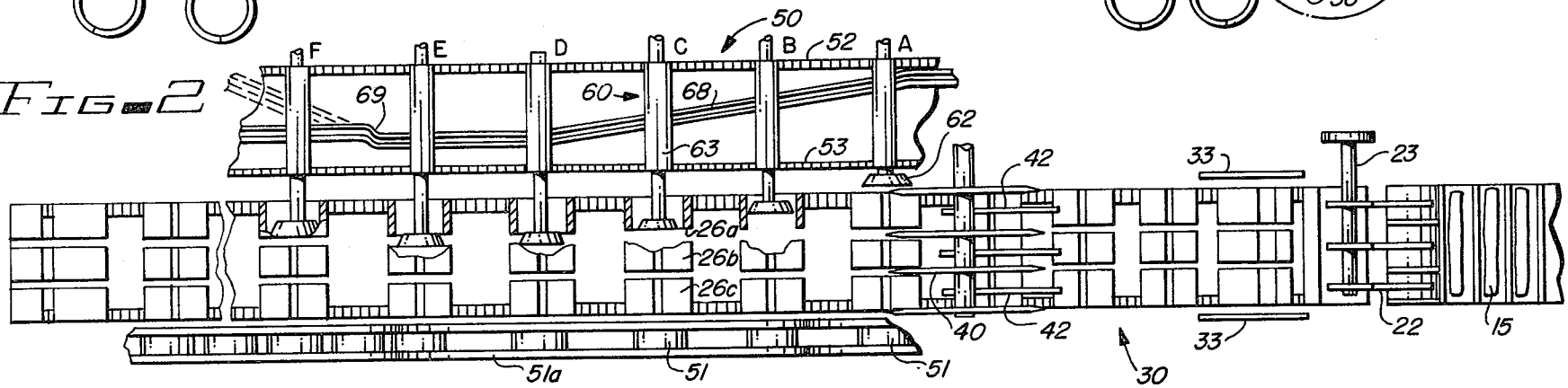
FIG. 2 is a top view of FIG. 1.
Figure 4:
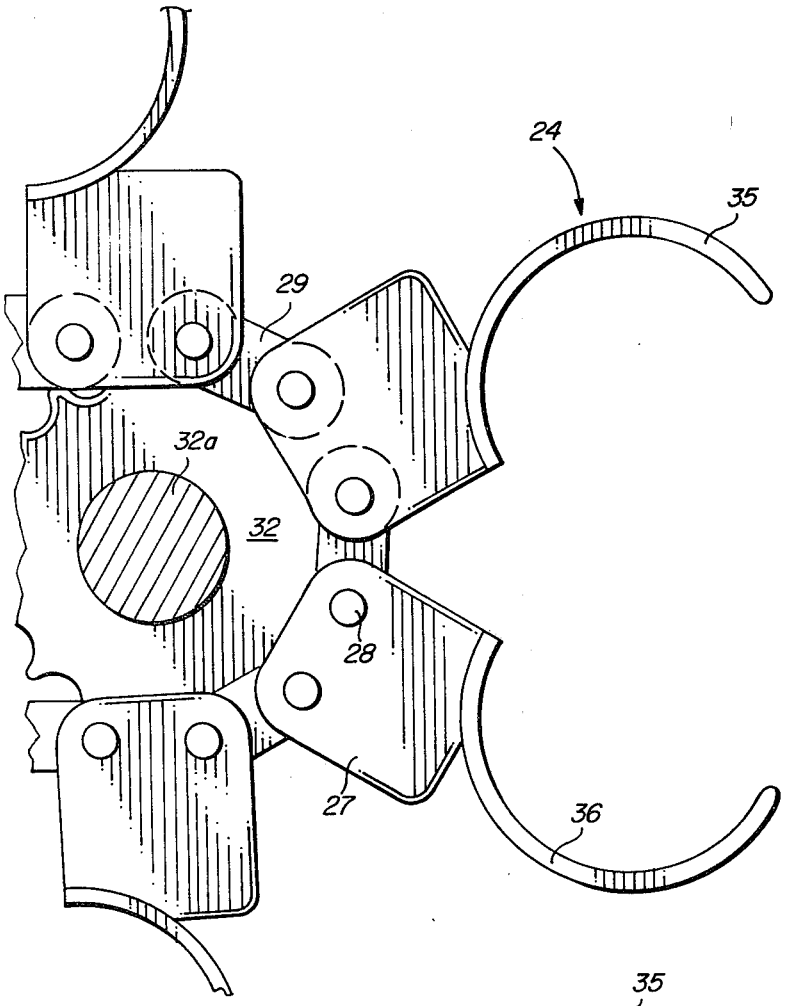
FIG. 4 is an enlarged side view of an open cup assembly as shown in FIG. 1 at point 4.
Figure 5:
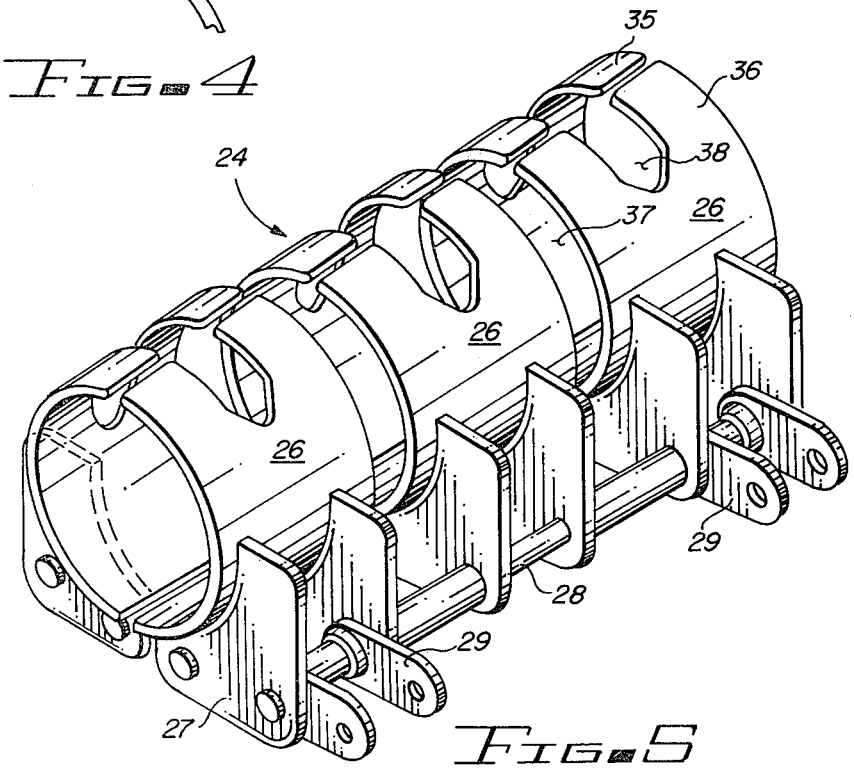
FIG. 5 is an enlarged perspective view of a cup assembly used in the invention.

Endless conveyor 30 comprises head sprocket 31 and tail sprocket 32 and continuous conveyor chain 33. Mounted to the conveyor chain 33 are a series of openable cup-like assemblies 24. The construction and mounting of the cup assembly is shown in greater detail in FIG. 4 and FIG. 5. As shown most clearly in FIG. 5, a preferred cup assembly consists of a series of cylindrical shaped cups 26 which are mounted by means of mounting tabs 27 to the conveyor chain. A mounting pin 28 is positioned through each of the mounting tabs and to link 29 of the conveyor chain. Each individual cup consists of cup halves 35 and 36 and although each cup half is securely mounted to the chain they are articulated with respect to each other. Thus, as shown in FIG. 4, as the cup assemblies move about sprocket 32, the articulated mounting causes each cup of the assembly to open. It will be appreciated that each cup assembly could consist of a pair of cup halves to form one cylindrical shaped cup although it is preferred that each assembly include a plurality of cups mounted side by side as shown in FIG. 5. Preferably each individual cup of the cup assembly is tapered as shown in FIG. 5, which serves to aid in transferring product from one cup to another in the cup assembly as well as the transfer of product from the cup to a container. Between each cup 26 of cup assembly 24 is a space 37 which permits knife blades 40 to cut the product contained in the cup assembly to predetermined lengths. As shown in FIG. 2, a series of circular knife blades are mounted immediately above conveyor assembly 30 to cut the product contained within the cup assembly. FIG. 7 shows in greater detail the circular knife blades mounted on knife shaft 41, with two of the circular knife blades passing through the space 37 between adjacent cups; the remaining 2 circular knife blades being positioned so that they cut product at the ends of the cup assembly. As seen in FIG. 5 and FIG. 7, each individual cup of cup assembly 24 is also provided with a notched area 38 which permits the use of a mechanical hold down 42 during the cutting operation. This is shown most clearly in FIG. 1 and FIG. 2 where a series of such hold downs 42 are mounted in the cutting area, the bottom edge of each protruding into notched area 38 of the cup assemblies. As previously stated knife blades 40 are mounted to shaft 41 and, although not shown, can be so mounted as to provide for adjustability between adjacent knife blades. Thus variation in the cut length of the product within the cup assembly is possible.

As shown in FIG. 2, positioned immediately adjacent to the cup assemblies and shown generally at 50 are means for transferring product contained within the cup assemblies into appropriate containers 51. Although FIG. 2 and FIG. 8 show only a portion of this total assembly, it consists of an endless conveyor with conveyor chains 52 and 53 which are suitably mounted to sprockets at each end of the conveyor. The conveyor assembly for mounting the means for transferring product from the cup assembly into containers and the conveyor chain for the cup assemblies themselves can be provided a common drive shaft and are synchronized and driven at the same speed. As shown most clearly in FIG. 2, a pusher assembly 60 is mounted to conveyor chains 52 and 53 and each individual pusher assembly is in registry with each cup assembly. Referring to FIG. 9 pusher assembly 60 consists of a push rod 61 to which is mounted tapered piston 62. The rod and piston are slidably mounted within a pusher housing 63 and the assembly is mounted to conveyor chains 52 and 53 by means of mounting brackets 64 and retainer pin 65. Depending from push rod 61 is a cam follower 66 which rides in cam track 68. The underside of pusher housing 63 is also provided with a cam follower slot 67 so that the push rod 61 can move transversely within the pusher housing. The transverse movement of the push rods is controlled by cam track 68. Cam follower 66 is constrained in the cam track and as the pusher assembly moves longitudinally in synchronization with the cup assemblies, transverse motion is imparted to the push rod by means of the particular path of the cam track. As shown at point A in FIG. 2, the pusher assembly is in registry with each cup assembly and the push rod and piston is just beginning its transverse movement toward the cup assembly. As the path of the cam track 68 approaches the conveyor with the cup assemblies, the push rod 61 is caused to continue its movement toward the cup assembly. At point B, the piston has entered the cup area; at point C the piston has traveled the distance of the first cup of cup assembly 24 and at points D and E, the piston has traveled entirely through the cup and into the space 37 between adjacent cups. At point F the path of the cam track as shown in FIG. 7 and FIG. 10 at 69 is such that it causes the piston to retract slightly which serves to relieve pressure on product still remaining in the cup assembly. The piston 62 maintains its slightly retracted position for a period until it begins its further transverse movement toward the center cup 26 of the cup assembly. Although FIG. 2 shows the activity of the pusher assembly during a so-called first station, as shown in FIG. 10, the path of the cam track during the second and third stations is basically a repetition of what occurs at the first station. Referring again to FIG. 10, as the pusher assemblies and adjacent cup assemblies enter the third station, the pushing action of the first and second stations is repeated causing the remaining product contained in the cup assembly to be forced into the containers. It should be noted that the cam track at the latter portion of the third station 70 is so designed as to quickly retract the push rod and piston from the cup assembly. This is also shown by the dotted pathway 71 of FIG. 8. The travel of the cam track for the return of the cup assemblies at the underside of the conveyor assembly 50 is shown generally at 72 in FIG. 10.

As shown in FIG. 1 and FIG. 2, empty containers are delivered in registry with each cup assembly 24 and can be delivered by means of gravity through chute 51*a* to a can conveyor consisting of a series of individual carriers with each carrier receiving a container from the gravity chute. The can is firmly held in the can carrier and the movement of the can carrier is synchronized with the movement of the cup assemblies so that an open end of a container is in registry with each cup assembly. After the product has been transferred from the cup assembly into the container, the filled container is removed for inspection and further processing.

OPERATION

Figure 6:
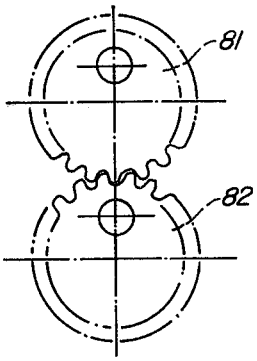
FIG. 6 is a diagrammatic view of the eliptical gearing employed in the present invention.

The operation of the apparatus of the present invention will be described assuming that the ultimate product to be packaged in a container is a vienna sausage approximately 2¼ inches in length with 7 sausages to be packaged in each container. It is of course understood that the apparatus operates to package other products varying in number, length and diameter. Each compartment 14 of endless conveyor 11 is loaded with a sausage approximately 7½ inches in length. The sausages are conveyed to and around the curvature of sprocket 12 and of course held in their respective compartments by flights 16*a* and by front cage 16. Each individual sausage drops by gravity onto metering device 20 which rotates in the same direction as sprocket 12. The metering device then passes the individual sausages to the lower cage assembly 17 consisting of lower cage 19 and the lower portion 18 of front cage 16. The metering device rotates at a higher speed than sprocket 12, creating a separation between adjacent sausages as they fall by gravity. As shown in FIG. 1 and FIG. 11, 7 individual sausages have passed by metering device 20 into the lower cage assembly. After the 7th sausage has dropped into the lower cage assembly, sweep fingers 22 interpose between the 7th sausage and the next awaiting sausage. The sweep fingers rotate in a direction counter to that of the metering device and push the group of 7 sausages through the lower cage assembly into the open cup assembly 24. The side guides 25 which are mounted on each side of lower cage assembly 17 serve to keep the sausages in alignment as they are picked up by the sweep fingers and transferred into the moving open cup assembly. The sweep fingers travel about shaft 23 at a continuously varying velocity; that is, the velocity of the sweep fingers is increased in the area between the leading half 35 and trailing half 34 of open cup assembly 24 in the loading area prior to the closing of the cup assembly. In any given cycle, sprocket shaft 13 rotates 0.7 revolution, thereby dropping 7 sausages in the area of the metering device. In this same cycle the metering device makes about 12.5 revolutions, thereby speeding up movement of the sausages into the lower cage area. During such a cycle the product sweep arm shaft 23 rotates one full revolution and the shaft 32*a* of sprocket 32 rotates ⅓ of a revolution. It will be seen particularly from FIG. 11 that during the transfer of the sausage products from the lower cage assembly into the moving open cup assembly, the cup assembly is open to receive product for only about 35 degrees of a revolution of shaft 32*a*. It has been determined that if the sweep arm shaft revolved at a constant velocity, the displacement of the sweep fingers would not be enough to deposit a sufficient number of sausages into the moving cup assembly during the relatively small period of time that the cup is open to receive sausages. It has been discovered that a variable velocity mechanism employed to speed up the travel of the sweep arms during the loading cycle and slow it down during the remainder of the cycle solves the problem. The means for accomplishing this can be a set of elliptical gears, driving gear 81 and driven gear 82 which are connected to the sweep finger assembly by means of chain 83. As shown in FIG. 11 these elliptical gears can be driven from shaft 13 of sprocket 12 by means of chain 84. Referring to FIG. 6 and FIG. 11, we find that a pair of elliptical gears having a velocity and displacement ratio of 2:1 or 1.5:1 works well. The elliptical gears employed herein have the property of constantly varying angular output with a given constant angular input. The chart shown below gives the angular displacement and velocity of the output gear for various increments of uniform angular input.

| Input Shaft Angle° (Driving Gear) | Output Shaft Angle° (Driven Gear) K = 2 | Output Shaft Velocity K = 2 |
|---|---|---|
| 0 | 0 | 2.00 |
| 10 | 19.84 | 1.95 |
| 20 | 38.85 | 1.83 |
| 30 | 56.37 | 1.66 |
| 40 | 72.1 | 1.48 |
| 50 | 86.0 | 1.30 |
| 60 | 98.21 | 1.14 |
| 70 | 108.94 | 1.00 |
| 80 | 118.42 | .89 |
| 90 | 126.86 | .80 |
| 100 | 134.47 | .72 |
| 110 | 141.40 | .66 |
| 120 | 147.79 | .61 |
| 130 | 153.75 | .57 |
| 140 | 159.37 | .54 |
| 150 | 164.73 | .52 |
| 160 | 169.92 | .51 |
| 170 | 174.99 | .50 |
| 180 | 180.00 | .50 |

It will be observed from this chart that the displacement of the output shaft (driven gear) 82 does not displace linearly with the input shaft (driving gear) 81, thus providing velocity variation within certain limits. Thus between 0 and almost 80 degrees, for each degree of increase in the input shaft angle, one obtains more than a degree of increase in the angle of the output shaft. This results in an increase in shaft movement in that area and of course causes a speed up in the velocity of sweep fingers 22.

As each cup assembly continues in its travel around sprocket 32, the cup halves close about the sausages. A series of lower product guides 86 serve to assist the movement of the sausages into the cup assembly in the desired configuration as shown in FIG. 11. In addition a series of top guides 87 tends to guide and hold the sausages in the cup assembly after product has been introduced into the cup assembly and before the cup halves close. The cup assembly containing sausages is then conveyed through the circular knife blades where the sausages are cut into three equal lengths of $2\frac{1}{4}''$. While the cup assembly travels through the cutting operation a series of hold downs 42 protrude into the notched area 38 of each cup and firmly hold the product in place during the cutting operation.

After the sausages have been cut to predetermined lengths, the cup assemblies continue their travel until they reach the area designated at point A of FIG. 2 where the moving cup assemblies are in registry with the moving pusher assemblies. The cam actuated push rod 61 and piston 62 begin to move toward the cup assembly and as shown at point C of FIG. 2 the piston has traveled transversely through cup 26*a* of the cup assembly causing the transfer of the sausages from cup 26*c* into the container. As the pusher assemblies continue their travel the push rod retracts somewhat, shown at station F, to relieve pressure on sausages still remaining in the cup assembly and remains in this position for a period until, as shown in FIG. 8 and FIG. 10, the push rod and piston again begin a transverse movement toward center cup 26*b* of the cup assembly to cause the transfer of sausages from the cup assembly to the container. The same action is repeated again causing all the sausages in the cup assembly to be transferred to a container. All of the sausages have now been removed from the cup assembly and it continues its movement around head sprocket 31 and returns to the area of tail sprocket 32 where the cup again opens to receive a group of sausages.

By means of the present invention, stick-like food products such as cooked sausages are collated, cut and packed into containers at high speed, with virtually no manual handling and with better quality control over the final packaged product. The apparatus as specifically described herein using 3 cups per cup assembly can effectively operate at about 360 filled cans per minute. Although this described apparatus utilizes 3 cups per cup assembly, it will be appreciated that the number of cups per cup assembly may be varied to suit production requirements.

Although the invention has been described above with particular reference to an illustrated specific embodiment, it is to be understood that various modifications and equivalent structure may be resorted to without departing from the scope of the invention as defined in the appended claims.

We claim:

1. Apparatus for packing a plurality of elongated, cylindrical articles into containers comprising in combination:

means for accumulating said articles for transfer to a moving cup assembly mounted on an endless conveyor said means including a chute-like area having upper and lower portions, conveyor means for bringing a plurality of said articles in parallel, axially aligned relationship to the upper portion of said chute-like area, metering means positioned between said upper and lower portions to cause a separation between adjacent articles as they move from the upper to the lower portion of said chute-like area;

an endless conveyor positioned adjacent to the lower portion of said chute-like area with a cup assembly secured to said conveyor, said assembly being adapted to hold a plurality of said articles and being at least partially open when immediately adjacent to the lower portion of said chute-like area to receive said articles;

sweep means positioned between said accumulating means and said endless conveyor for transferring said articles into said cup assembly, said sweep means being rotatable at a variable velocity with the end portion thereof extending into the lower portion of said chute-like area whereby rotation of said sweep means periodically engages an article to effect the transfer of a plurality of said articles into said cup assembly, the velocity of said sweep means being increased when said cup assembly is immediately adjacent the lower portion of said chute area; and means for transferring articles from said cup assembly to a container.

2. The apparatus of claim 1 wherein said endless conveyor positioned adjacent to the lower portion of said chute area includes a head sprocket and a tail sprocket, an endless chain engaged about said sprockets, said head sprocket being positioned immediately adjacent to said lower portion of the chute area, and wherein a plurality of cup assemblies are transversely mounted to said chain and in longitudinally spaced relationship to each other and wherein each cup assembly includes a pair of generally circular shaped cup halves articularly mounted to said chain, said cup halves being normally together to form a generally cylindrical shaped receptacle but openable as said assembly passes about said sprockets to receive said articles.

3. The apparatus of claim 1 wherein said means for transferring articles from said cup assembly to a container comprises a pusher assembly in registry with said cup assembly and mounted transversely thereto, said pusher assembly being mounted to an endless conveyor and movable at the same speed as said cup assembly.

4. The apparatus of claim 3 wherein said pusher assembly comprises a housing, a push rod slidably mounted within said housing, a piston mounted at one end of said push rod, and a cam follower mounted to said push rod and riding in a cam track.

5. The apparatus of claim 4 wherein the path of said cam track is such that longitudinal movement of said cup assembly and pusher assembly causes said push rod and piston to move transversely toward the interior of said cup assembly.

6. The apparatus of claim 2 wherein said cup assembly includes a plurality of said cylindrical shaped receptacles mounted in side-by-side relationship on said chain.

7. The apparatus of claim 6 wherein each of said receptacles is tapered.

8. The apparatus of claim 7 wherein a space is provided between each of said receptacles.

9. The apparatus of claim 5 wherein said cup assembly includes a plurality of cylindrical shaped receptacles mounted in side-by-side relationship and wherein a space is provided between said receptacles and wherein the path of said cam track is such that longitudinal movement of said cup assembly and pusher assembly cause said push rod and piston to move transversely through the interior of each of said receptacles of said cup assembly.

10. The apparatus of claim 9 wherein each of said receptacles contains articles of a predetermined length and wherein the path of said cam track is such that transverse movement of said piston is stopped for a time period between successive receptacles.

11. The apparatus of claim 10 wherein the path of said cam track is such that the movement of said push rod and piston is reversed for a distance after said piston has moved through the interior of the first receptacle of said cup assembly prior to continuing its movement through the next receptacle.

12. The apparatus of claim 2 wherein said sweep means comprises a series of finger-like projections transversely mounted on a shaft wherein said shaft is connected to a drive means so as to cause said shaft to rotate at a continuously varying velocity.

13. The apparatus of claim 12 wherein said drive means includes a pair of eliptical gears.

14. The apparatus of claim 13 wherein said gears have a velocity and displacement ratio of from about 2:1 to about 1.5:1.

15. The apparatus of claim 14 wherein for each one revolution of said shaft on which are mounted finger-like projections the shaft of said head sprocket travels $\frac{1}{3}$ revolution.

* * * * *